United States Patent [19]

Fujimoto et al.

[11] Patent Number: 4,599,834

[45] Date of Patent: Jul. 15, 1986

[54] SEISMIC ISOLATOR

[75] Inventors: Shigeru Fujimoto; Satoshi Ohte; Hirofumi Kondo; Takuji Matsumoto, all of Yokohama; Takafumi Fujita, Chiba, all of Japan

[73] Assignee: Kabushiki Kaisha Toshiba, Kawasaki, Japan

[21] Appl. No.: 665,159

[22] Filed: Oct. 26, 1984

[30] Foreign Application Priority Data

Oct. 27, 1983 [JP] Japan ..... 58-201294

[51] Int. Cl.[4] ..... E04H 9/02

[52] U.S. Cl. ..... 52/167

[58] Field of Search ..... 52/167; 248/585, 583, 248/584, 580, 638; 308/6 R

[56] References Cited

U.S. PATENT DOCUMENTS

| | | | |
|---|---|---|---|
| 3,638,377 | 2/1972 | Caspe . | |
| 3,794,277 | 2/1974 | Smedley et al. | 52/167 X |
| 4,187,573 | 2/1980 | Fyfe et al. | 52/167 X |
| 4,496,130 | 1/1985 | Toyama | 52/167 X |
| 4,517,778 | 5/1985 | Nicolai | 52/167 |

FOREIGN PATENT DOCUMENTS

| | | | |
|---|---|---|---|
| 0076573 | 4/1983 | European Pat. Off. . | |
| 3040181 | 5/1982 | Fed. Rep. of Germany . | |
| 2328810 | 5/1977 | France | 52/167 |
| 2492866 | 4/1982 | France . | |
| 1422772 | 1/1976 | United Kingdom . | |

*Primary Examiner*—John E. Murtagh
*Assistant Examiner*—Richard E. Chilcot, Jr.
*Attorney, Agent, or Firm*—Oblon, Fisher, Spivak, McClelland & Maier

[57] ABSTRACT

A seismic isolator has a sliding plate fixed on the lower surface of a building, a connecting plate underlying the sliding plate, an elastic first support disposed between the connecting plate and a foundation of the building to support the building, a second support disposed between the connecting plate and the foundation and urged by a biasing force of a spring member such that its upper end is brought into tight contact with the lower surface of the connecting plate, and a jack for adjusting the biasing force of the spring member. A frictional force acting between the sliding plate and the connecting plate is larger than that between the connecting plate and the upper end of the second support.

11 Claims, 11 Drawing Figures

SEISMIC ISOLATOR

BACKGROUND OF THE INVENTION

The present invention relates to a seismic isolator for protecting a structure against damage or destruction caused by earthquake vibrations, i.e., for isolating seismic vibrations to be transmitted to the structure and, more particularly, to a seismic isolator having a seismic isolating function which varies in accordance with the scale of an earthquake.

Various types of conventional seismic isolators are used in large structures such as buildings to prevent the buildings from damage or destruction caused by earthquake vibrations.

FIGS. 1 and 2 respectively show conventional seismic isolators. A plurality of seismic isloators each shown in FIG. 1 is inserted between a building 1 and its foundation 2 to support the weight of the building 1. When an earthquake occurs, the vibrations are reduced by the seismic isolators. The reduced vibrations are transmitted to the building 1, thereby protecting the building from damage or destruction. The seismic isolators shown in FIG. 1 comprises a support base 3 fixed on the foundation 2 and a support member 4 disposed between the support base 3 and the lower surface of the building 1. More specifically, the support member 4 comprises a lower end plate 5 fixed on the support base 3, an upper end plate 6 fixed on the lower surface of the building 1, and an elastic member 7 disposed between the lower and upper end plates 5 and 6 which is made of a vibration-proof material such as rubber vibration isolator or laminated rubber bearing. The elastic member 7 provides the building 1 with horizontal flexibility.

According to the seismic isolator shown in FIG. 1, when an earthquake occurs and its vibrations are transmitted from the foundation 2 to the building 1 through the support member 4, part of vibration energy of the earthquake is converted to deformation energy to be stored in the elastic member 7 since the elastic member 7 in the support member 4 is deformed horizontally due to earthquake vibrations. Therefore, the vibration energy of the earthquake is barely transmitted to the building 1, thereby improving the seismic proofing of the building 1.

These physical phenomenas means the vibration characteristics as follows. In the seismic isolators shown in FIG. 1, the primary natural frequency of the entire structure including the building 1 and the seismic isolators is sufficiently smaller than the natural frequency of the building 1 itself, thereby protecting the building 1 from resonant response.

However, in the seismic isolator shown in FIG. 1, the vibration energy of the earthquake is stored by only the elastic member 7 in the support member 4. The vibration energy component stored by the elastic member 7 upon its deformation is relatively small. As a result, the building 1 may not be effectively isolated by the seismic isolator shown in FIG. 1 for a medium scale earthquake (VII<M<VIII where M is the Modified Mercalli Intensity Scale). This is because in this case the deformation of the elastic member 7 in the support member 4 exceeds its allowance and so the elastic member 7 will be destroyed when an earthquake greater than a medium scale one occurs. Therefore, when such an earthquake occurs, the building 1 may be damaged or destroyed.

However, it is absolutely vital for some structures to be completely protected from earthquakes, irrespective of the scale of the earthquake. A typical example is a reactor building in a nuclear power station.

An seismic isolator used in a building such as a reactor building is illustrated in FIG. 2. The seismic isolator shown in FIG. 2 has substantially the same construction as that in FIG. 1. The same reference numerals in FIG. 2 denote the same parts as in FIG. 1, and a detailed description thereof will be omitted. A description will be made only of the different components.

The seismic isolation shown in FIG. 2 has a sliding plate 8 fixed on the lower surface of a building 1. The lower surface of the sliding plate 8 serves as a sliding surface. The upper surface of the upper end plate 6 in a support member 4 also serves as a sliding surface. The sliding surface of the upper end plate 6 is brought into slidable contact with that of the sliding plate 8.

When a small earthquake occurs, the vibration energy of the earthquake which would otherwise be transmitted to the building 1 can be stored by deformation of an elastic member 7 in the support member 4 in the same manner as the seismic isolator shown in FIG. 1. When an earthquake of more than a predetermined scale occurs, i.e., when a horizontal force acting on the sliding plate 8 and hence the building 1 exceeds a frictional force (corresponding to a product of a friction coefficient of the sliding surface of the sliding plate 8 and a weight imposed on the sliding plate 8 of the seismic isolator), the sliding plate 8 and hence the building 1 slides on the upper end plate 6. While the sliding plate 8 is sliding on the upper end plate 6, a force exceeding the frictional force will not be transmitted to the building 1 irrespective of the scale of the earthquake, and the acceleration of the lower portion of the building 1 will not exceed a product of the friction coefficient and the gravitational acceleration. In this case, when the building 1 starts sliding on the upper end plate 6 through the sliding plate 8, the vibration energy of the earthquake which can be spent by the seismic isolator shown in FIG. 2 corresponds to a product of a sliding displacement of the building 1 and the frictional force.

According to the seismic isolator in FIG. 2, therefore, when a relatively small earthquake occurs, part of the vibration energy of the earthquake which would otherwise be transmitted to the building 1 can be stored by the elastic member 7 in the support member 4. In addition, when a relatively large earthquake occurs, the building 1 itself is horizontally shifted such that the sliding plate 8 slides on the upper end plate 6 in the support member 4, thereby preventing excessive vibration energy from an earthquake having more than a predetermined value from being transmitted to the building 1.

In the seismic isolator shown in FIG. 2, the relationship between a displacement $\delta$ of the building 1 with respect to the foundation 2 and an earthquake force F transmitted to the building 1 is illustrated in FIG. 3 when the building 1 is vibrated by an earthquake at a constant amplitude. Referring to FIG. 3, line segment $A_0$ indicates a deformation state of the support member 4 immediately after the earthquake vibration is transmitted to the building 1, line segment $B_0$ indicates a deformation state of the support member 4 when the building 1 slides, line segment $c_0$ indicates a deformation state of the support member 4 toward a direction opposite the direction of the previous state thereof, line segment $D_0$ indicates a sliding state of the building 1 toward a direction opposite that of the previous state thereof, and line segment $E_0$ indicates a deformation state of the support member 4 toward the direction of the previous state. The region surrounded by the line segments $B_0$, $C_0$, $D_0$, and $E_0$ excluding the line segment $A_0$ indicates the earthquake vibrations energy to be spent by a cycle of sliding when the building 1 slides on the upper end plate 6 through the sliding plate 8. However, when a magnitude or scale of the earthquake does not cause sliding of the building 1, the relationship between the earthquake force acting on the building 1 and the displacement of the building 1 is represented by line segment $A_0$ and broken line segment $A_0'$.

As is apparent from the above description according to the seismic isolator shown in FIG. 2, when an earthquake is of more than a predetermined scale, the building 1 is displaced such that the sliding plate 8 slides on the upper end plate 6 in the support member 4, and a force exceeding the force $F_0$ will not act on the building 1 irrespective of the scale of the earthquake, as is apparent from FIG. 3. In the seismic isolator shown in FIG. 2, even in the case of a strong earthquake having a large scale ($M<IX$ where M is the modified Mercalli Intensity Scale), the building 1 will not be damaged or destroyed.

Indeed the seismic isolator (FIG. 2) has the above advantages, but it also has the following drawback. With this seismic isolator it is difficult to determine how large an earthquake may slide the building 1. If the seismic isolator is so designed as to cause the building 1 to slide when an earthquake of medium scale or a greater scale hits the building 1, its seismic isolation effect is achieved by only the deformation of the elastic member 7, which stores the vibration energy of the earthquake, when an earthquake smaller than the medium scale earthquake occurs. Consequently, in this condition, the vibration energy of the earthquake is not effectively spent by the seismic isolator of FIG. 2. Thus, this seismic isolator has the same disadvantage as the apparatus of FIG. 1.

For this reason, the seismic isolator (FIG. 2) must be so designed as to cause the building 1 to slide when an earthquake smaller than the medium scale earthquake occurs. Once the building 1 slides, the building 1 will not always return to the initial position even when the earthquake has finished. In other words, it is quite possible that the building 1 is displaced with respect to the foundation 2 when the earthquake has finished. Therefore, as the building 1 is displaced from the initial position, large-scale repair must be performed to set the building 1 back in the initial position.

In addition, it seems that earthquakes of medium scale frequently occur in the district, that is, high seismic zone, where the structures with the seismic isolation are built. Every time the medium scale earthquake occurs, the building 1 must be repaired, resulting in a reduction in utility of the system including the building 1, and in high repair costs.

SUMMARY OF THE INVENTION

It is an object of the present invention to provide a seismic isolator for a structure wherein the structure can be properly protected against an earthquake having the highest magnitude, and wherein the entire system, including the structure, can be smoothly restored immediately after an earthquake which has a medium magnitude and frequently occurs has finished.

In order to achieve the above object of the present invention, there is provided a seismic isolator for a structure, comprising: a first sliding plate fixed on a lower surface of the structure and having a lower surface as a first sliding surface; a second sliding plate having an upper surface brought into slidable contact with the first sliding surface of the first sliding plate; first supporting members disposed between the second sliding plate and a foundation and having elasticity, the first supporting members having a lower end fixed on the foundation and an upper end fixed on the lower surface of the second sliding plate; second supporting members disposed between the second sliding plate and the foundation to be dynamically parallel to the first supporting members and having elasticity only along a vertical direction, the second supporting members having a lower end fixed on the foundation and an upper end brought into tight contact with the lower surface of the second sliding plate, and the second sliding plate having a second sliding surface slidable on the upper end of the second supporting members; and an adjusting members for adjusting and holding an urging force, that is, a frictional force acting on the lower surface of the second sliding plate through the upper end of the second supporting members.

According to the seismic isolator of the present invention, when a frictional force between the first and second sliding plates, and a frictional force between the second sliding plate and the upper end of the second supporting members are given to be $F_1$ and $F_2$, respectively, the relation $F_1>F_2$ is established. The frictional force $F_2$ is substantially set equal to the force received by the structure in a medium earthquake. At the same time, the frictional force $F_1$ is substantially set the same as the force received by the structure in a large earthquake, thereby providing different isolation effects in accordance with the magnitude of the earthquake. When an earthquake which is smaller than a medium earthquake occurs, or when the force applied to the seismic isolator is smaller than $F_2$, then the seismic isolator fixes the structure to the foundation without performing the seismic isolation. However, when a medium or large earthquake occurs, the force received by the structure becomes larger than the frictional force $F_2$, and the second sliding plate slides on the upper end of the second supporting members. At the same time, the first supporting members will be horizontally deformed.

As described above, the seismic isolator will be never slide the building until a medium earthquake occurs, i.e., the seismic isolator has a so called trigger function for seismic acceleration.

Therefore, in this case, in comparison with the case of the conventional seismic isolator in FIG. 2, the earthquake vibration can be still reduced by the deformation of the first supporting members and the vibration energy consumption upon sliding between the upper end of the second supporting members and the second sliding plate. As a result, only reduced vibrations are transmitted to the structure. In addition, in the same manner as in the seismic isolator of FIG. 2, the structure is displaced from the initial position when the earthquake has finished. In other words, the structure is stopped at a position where the frictional force $F_2$ between the second sliding plate and the upper end of the second supporting members is balanced with the restoration force of the first supporting members. However, according to the seismic isolator of the present invention, the urging force of the upper end of the second supporting members which acts on the second sliding plate can be adjusted by the adjusting members. In other words, the frictional force $F_2$ can be adjusted. Therefore, when the frictional force $F_2$ is adjusted by the adjusting members to be zero, the structure can be automatically returned to the initial position by the restoration force of the first supporting members.

According to the seismic isolator of the present invention, after a medium to large earthquake which occurs frequently, even if the structure is displaced from the initial position, a large-scale repair operation need not be performed. The structure can be easily and quickly returned to the initial position by the adjusting members. Therefore, the time required for restoring the entire system, including the structure after the medium to large earthquake, can be shortened, thereby improving the efficiency of the entire system.

At the time of an extremely large earthquake which occurs very rarely, according to the seismic isolator of the present invention, the second sliding plate slides in the manner as described above, and the first sliding plate slides on the second sliding plate. As a result, the vibrations of an extremely large earthquake which would otherwise be transmitted to the structure can be sufficiently reduced, and only reduced vibrations are transmitted to the structure. Therefore, damage and destruction to the structure can be minimized, thereby guaranteeing the safety and soundness thereof.

DETAILED DESCRIPTION OF THE PREFERRED EMBODIMENTS

Figure 4:
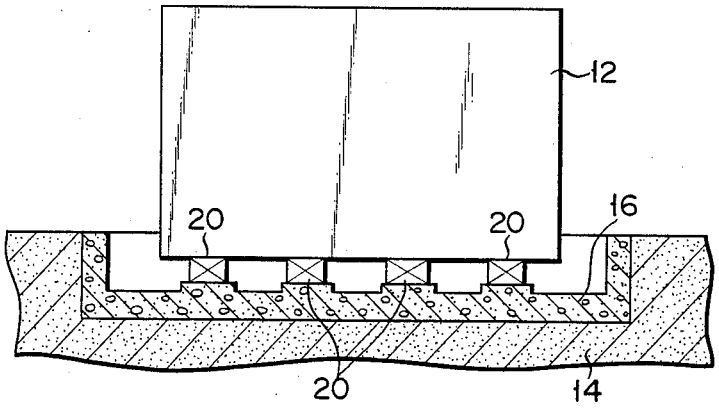
FIG. 4 is a schematic view showing the overall configuration of a system including a building with seismic isolators of the present invention.

FIG. 4 shows a structure such as a building 12 having a plurality of seismic isolators according to the present invention. A typical example of the building 12 is a reactor building in a nuclear power station. The building 12 is constructed on a foundation 16 on the soil 14 through seismic isolators 20 to be described in detail later. A plurality of seismic isolators 20 is installed between the building 12 and the foundation 16. Referring to FIG. 4, these seismic isolators 20 are schematically illustrated.

Figure 5:
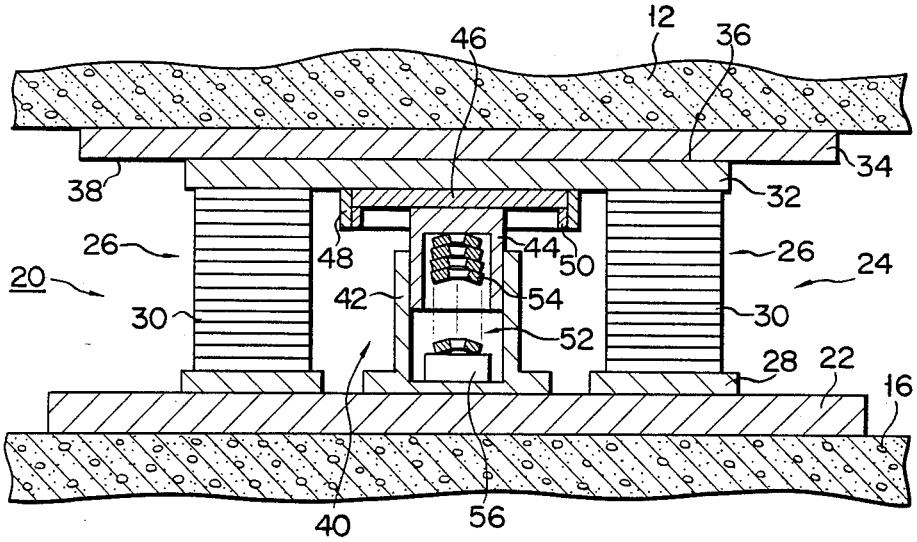
FIG. 5 is a sectional view of a seismic isolator according to an embodiment of the present invention.

FIG. 5 shows the detailed construction of one seismic isolator 20. All the seismic isolators have the same construction and are exemplified by the one illustrated in FIG. 5. The seismic isolator 20 has a base 22 fixed on the foundation 16. A first support 24 is disposed on the base 22. The first support 24 has a plurality of support members 26 arranged on the base 22 at equal angular intervals in a circle. Each support member 26 has a lower end plate 28 fixed on the base 22 and a column-like or rectangular prism-like elastic portion 30 extending from the lower end plate 28. The elastic portion 30 comprises a vibration isolation rubber, a laminate of vibration isolation rubber sheets or a member obtained by alternately stacking the isolation sheets and metal sheets. Therefore, the support member 26 has horizontal flexibility.

The upper end of the first support 24, i.e., the upper end of each support member 26 is coupled to a peripheral portion of a single disk-like or rectangular connecting plate 32. The upper surface of the connecting plate 32 is brought into slidable contact with the lower surface of a stainless steel sliding plate 34 fixed on the lower surface of the building 12. In other words, the upper surface of the connecting plate 32 and the lower surface of the sliding plate 34 comprise sliding surfaces 36 and 38, respectively. The connecting plate 32 may be made of a material different from the material (i.e., stainless steel) of the sliding plate 34, or of stainless steel with another metal. The size of the sliding plate 34 is sufficiently larger than that of the connecting plate 32. As shown in FIG. 5, the sliding plate 34 is independent of the building 12. However, the sliding plate 34 may constitute a bottom wall of the building 12.

A second support 40 is disposed on the base 22 within the first support 24, i.e., surrounded by the support members 26. The second support 40 has a cylinder 42 fixed on the base 22 in such a manner that an opening of the cylinder 42 faces upward. A piston 44 is slidably fitted in the cylinder 42 and is movable along a vertical direction. The upper end of the piston 44 extends upward from the opening of the cylinder 42. The upper end of the piston 44 further abuts against the lower surface of a disk-like or rectangular auxiliary sliding plate 46 fixed on the lower surface of the connecting plate 32. A spring member 52 is housed in the cylinder 42 to urge the piston 44 upward. As shown in FIG. 5, the spring member 52 comprises, for example, a plurality of disk springs. In order to constitute the support member 40, a spring such as a coil spring, a ring spring or a volute spring having high rigidity and durability may be used in place of the disk spring. A stop ring 48 is fixed at the lower surface of the connecting plate 32 so as to surround the auxiliary sliding plate 46 and the upper end of the piston 44. A buffer ring 50 made of an elastic material such as rubber is fixed on the inner surface of the stop ring 48 to overlap with the auxiliary sliding plate 46. The auxiliary sliding plate 46 is not necessarily used in the damping apparatus according to the present invention. For example, the lower surface portion of the connecting plate 32 which is surrounded by the buffer ring 50 may serve as a sliding surface so as to bring the upper end of the piston 44 into slidable contact with the connecting plate 32. In this case, components corresponding to the stop ring 48 and the buffer ring 50 must be provided. A horizontal space between the stop ring 48 and the piston 44 is smaller than a maximum allowable horizontal displacement of the support member 26.

The seismic isolator shown in FIG. 5 also has an adjusting and holding mechanism 56 which is disposed in the cylinder 42 to adjust and hold a biasing force of the spring member 52. The adjusting and holding mechanism 56 is schematically illustrated in FIG. 5. The adjusting and holding mechanism 56 comprises a screw jack or a hydraulic jack disposed between the lower end of the spring member 52 and the bottom wall of the cylinder 42. A load sensor such as a load cell or a pressure sensor for detecting the biasing force of the spring member 52 is arranged in the adjusting and holding mechanism 56 to detect an urging force of the piston 44. The adjusting and holding mechanism 56 is operated, for example, in response to an electrical control signal. After the urging force of the piston 44 is adjusted by the adjusting and holding mechanism 56, this mechanism 56 holds the urging force of the piston 44 to the predetermined value.

In the seismic isolator of the present invention, when a frictional force between the sliding plate 34 and the connecting plate 32, and a frictional force between the auxiliary sliding plate 46 and the piston 44 are given to be $F_1$ and $F_2$, respectively, a relation $F_1 > F_2$ is established. This relation can be easily realized in the following manner. A load acting between the sliding plate 34 and the connecting plate 32, and a friction coefficient (wherein the coefficient of static friction is the same as that of dynamic friction) between the sliding plate 34 and the connecting plate 32 are given to be $P_1$ and $\mu_1$, respectively. A load acting between the auxiliary sliding plate 46 and the piston 44, and the friction coefficient between the auxliary sliding plate 46 and the piston 44 are given to be $P_2$ and $\mu_2$, respectively. The frictional forces $F_1$ and $F_2$ are then given as follows:

$$F_1 = \mu_1 \times P_1$$

$$F_2 = \mu_2 \times P_2. \quad (1)$$

In this case, an overall weight W of the building 12 acts between the sliding plate 34 and the connecting plate 32, so that a relation $P_1 = W$ is established. When a load received by the first support 24 is defined as $P_3$, the relationship between the weight W of the building 12 and the loads $P_2$ and $P_3$ is given by a relation $W = P_2 + P_3$. Therefore, the loads $P_1$ and $P_2$ satisfy an inequality $P_1 > P_2$. As a result, when it is assumed that the friction coefficients $\mu_1$ and $\mu_2$ are equal to each other, a relation $F_1 > F_2$ is established, as is apparent from equations (1).

In the above description, the friction coefficient $\mu 1$ becomes equal to the friction $\mu_2$. However, a relation $\mu_1 < \mu_2$ is preferably established. This is because the load $P_2$ acting the auxiliary sliding plate 46 and the piston 44 can be decreased if this relation is satisfied. As a result, the load acting on the spring member 52 and the adjusting and holding mechanism 56 and the size of the mechanism 56 itself can be decreased.

Under the assumption that the relationship between the frictional forces $F_1$ and $F_2$ is given in the manner described above, an acceleration of the building 12 along the horizontal direction caused by sliding between the sliding plate 34 and the connecting plate 32, and an acceleration of the building 12 caused by sliding between the auxiliary sliding plate 46 and the piston 44 are given to be $\alpha_1$ and $\alpha_2$, respectively. The accelerations $\alpha_1$ and $\alpha_2$ can be derived as follows:

$$\alpha 1 = \mu_1 \times g$$

$$\alpha 2 = (P_2/P_1) \times \mu_2 \times g \quad (2)$$

where g is the gravity acceleration.

As is apparent from the equations (2), the accelerations $\alpha_1$ and $\alpha_2$ satisfy an inequality $\alpha_1 > \alpha_2$. The values of the accelerations $\alpha_1$ and $\alpha_2$ which satisfy the above inequality will be described in more detail below. The acceleration $\alpha_1$ is slightly smaller than the maximum acceleration which the building 12 can bear. The acceleration $\alpha_2$ is slightly smaller than an acceleration applied to the lower portion of the building 12 when a medium earthquake occurs. The accelerations $\alpha_1$ and $\alpha_2$ are determined considering the friction coefficients $\mu_1$ and $\mu_2$ and the loads $P_1$ and $P_2$.

It should be noted that the acceleration $\alpha_2$ can be variable as the biasing force of the spring member 52 is adjusted by the adjusting mechanism 56.

Figure 6:
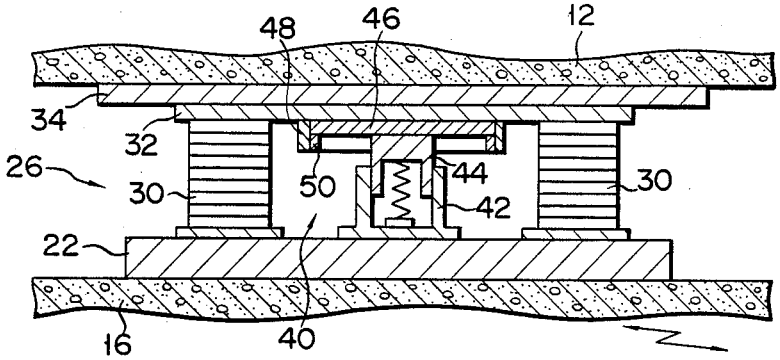
FIGS. 6 to 8 are side views for explaining the isolation effect of the seismic isolator shown in FIG. 5.

The seismic isolator will be described with reference to FIGS. 6 to 10 when the accelerations $\alpha_1$ and $\alpha_2$ are given as described above. When a relatively small earthquake of less than a medium magnitude occurs, the seismic isolator will not operate and does not provide the damping function, as shown in FIG. 6, since the auxiliary sliding plate 46 is integrally connected with the piston 44 by the friction force $F_2$. However, since the allowable maximum acceleration relative to the building 12 is slightly larger than the acceleration $\alpha_1$, the building 12 will not be damaged or destroyed by such a medium earthquake.

Figure 7:
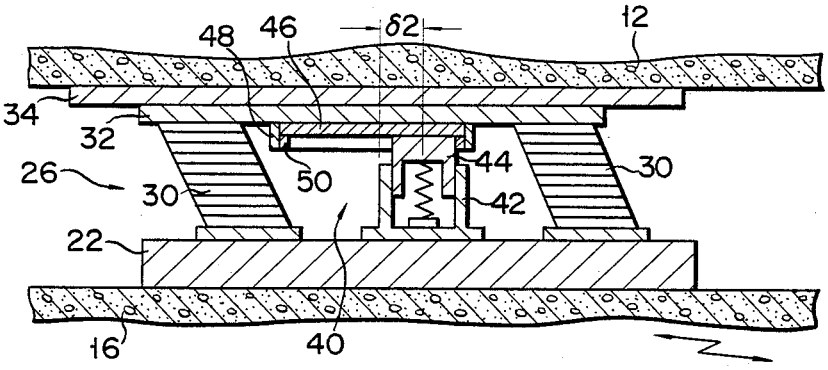

On the other hand, when an earthquake having a magnitude larger than the medium magnitude occurs, i.e., when the maximum acceleration applied to the building 12 exceeds the acceleration $\alpha_2$ but is smaller than the acceleration $\alpha_1$, sliding occurs between the auxliary sliding plate 46 and the piston 44, as shown in FIG. 7, so that the building 12 horizontally slides at a predetermined amplitude while the elastic portion 30 in each support member 26 of the first support 24 is deformed. In this case, the vibration energy of the earthquake which would otherwise be transmitted to the building 12 is stored by deformation of the elastic position 30 of each support member 26 and is spent to produce the sliding motion of the auxiliary sliding plate 46 on the piston 44. Therefore, only reduced vibrations are transmitted to the building 12.

Figure 9:
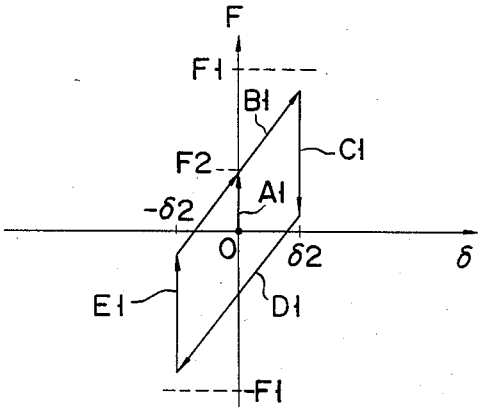
FIGS. 9 and 10 are graphs for explaining the force-displacement characteristics of the seismic isolator shown in FIG. 5.

In this case, the relationship between the horizontal force F acting on the building 12 and the displacement $\delta$ of the building 12 from the initial position is illustrated in FIG. 9. Line segment $A_1$ indicates the displacement of the building 12 immediately after the earthquake vibration was transmitted to the building 12. Line segment $B_1$ indicates the displacement of the building 12 when sliding occurs between the auxiliary sliding plate 46 and the piston 44, line segment $C_1$ indicates the state wherein an acceleration force acts on the building 12 in a direction opposite to the direction of the previous state, line segment $D_1$ indicates a state wherein the building 12 slides in a direction opposite to the direction indicated by the line segment $B_1$, and line segment $E_1$ indicates a state wherein the direction of the acceleration acting on the building 12 returns to the initial direction. The region surrounded by the line segments in FIG. 9 indicates the energy consumption of a cycle of the sliding of the building 12.

When the earthquake has finished, the building 12 is possibly balanced in the state that the building 12 is shifted from the initial position as shown in FIG. 7. That is, the building 12 is displaced by a amplitude of sliding from the initial position when the sliding of the auxiliary sliding plate 46 is stopped due to decreasing of the vibration of the earthquake itself. When the building 12 is stabilized in the state shown in FIG. 7, it must be returned to the initial position shown in FIG. 6. This operation can be easily performed in the following manner. The urging force of the piston 44 with respect to the auxiliary sliding plate 46 is set by the adjusting and holding mechanism 56 to be zero. When the force of the piston 44 which urges the auxiliary sliding plate 46 is set to be zero, the frictional force (corresponding to the restoration force of the deformed support member 26) acting between the auxiliary sliding plate 46 and the piston 44 becomes zero. Therefore, the building 12 can be automatically returned to the initial position by the restoration force of the support member 26. Thereafter, the urging force of the piston 44 which acts on the auxiliary sliding plate 46 can be adjusted to satisfy the acceleration $\alpha_2$, so that the seismic isolators of the present invention restore the initial states. Therefore, according to the seismic isolation of the present invention, the system including the building 12 can be restored in a short period of time when the earthquake has finished.

Figure 1:
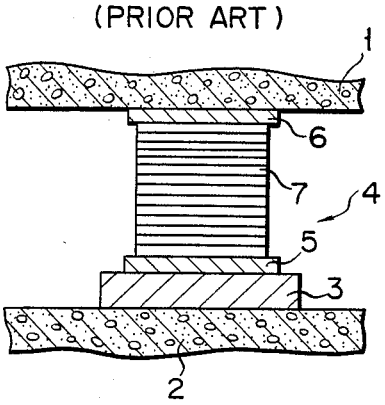
FIG. 1 (PRIOR ART)
FIG. 1 is a side view of a conventional seismic isolator.
Figure 2:
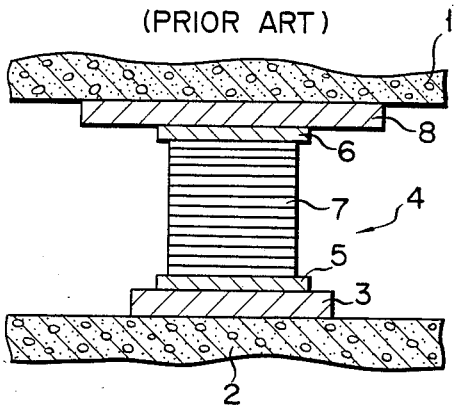
FIG. 2 (PRIOR ART)
FIG. 2 is a side view of another conventional seismic isolator.
Figure 3:
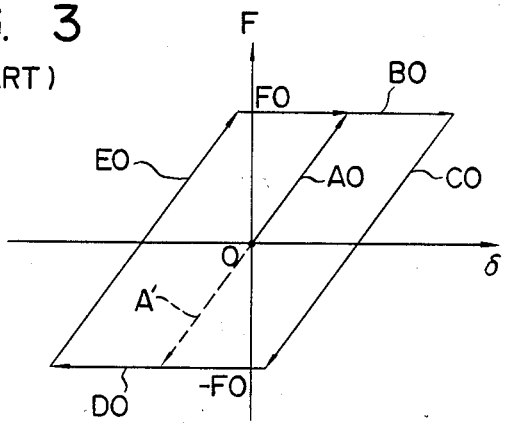
FIG. 3 (PRIOR ART)
FIG. 3 is a graph for explaining the force-displacement characteristics of the seismic isolator shown in FIG. 2.

In this case, the seismic isolator of the present invention can perform the seismic isolation function larger than the seismic isolator of FIG. 2 since the seismic isolation of the present invention has the damping function of the second support 40.

Figure 8:
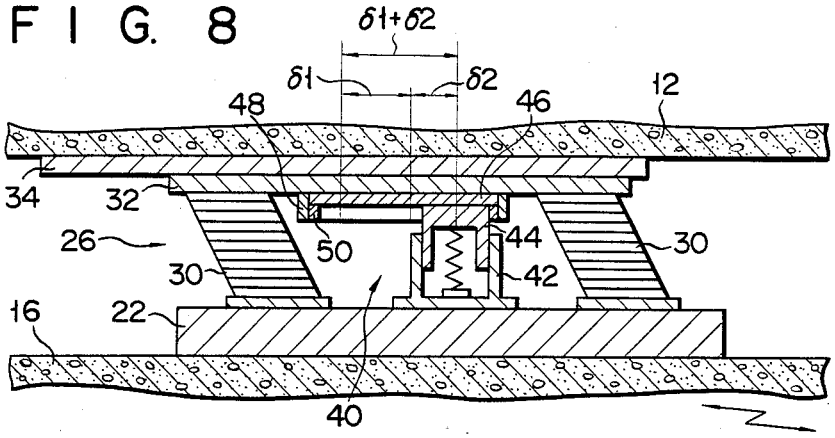
Figure 10:
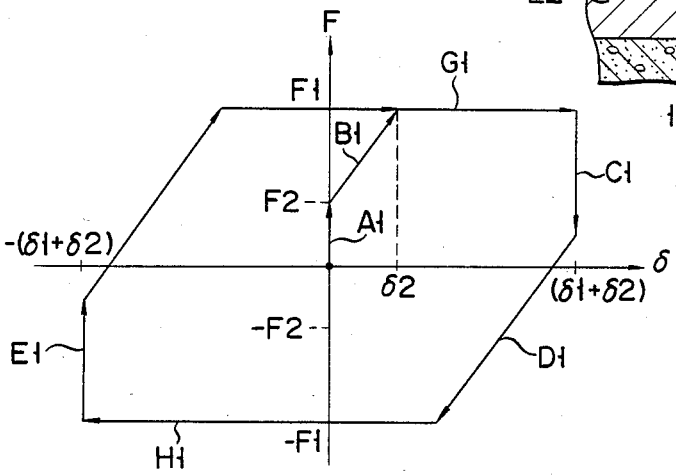

When an extremely large earthquake occurs, i.e., when the acceleration applied to the building 12 exceeds the acceleration $\alpha_1$, sliding occurs between the auxiliary sliding plate 46 and the piston 44, while the support member 26 is deformed. In addition, as shown in FIG. 8, sliding also occurs between the sliding plate 34 and the connecting plate 32. As a result, in addition to the isolation effect obtained during the earthquake described with reference to FIG. 7, sliding between the sliding plate 34 and the connecting plate 32 (i.e., the sliding of the building 12) effectively decreases vibration energy which would otherwise be transmitted to the building 12, thereby obtaining a more effective isolation effect. Since the sliding plate 34 slides on the connecting plate 32, an acceleration exceeding the acceleration $\alpha_1$ will not act on the building 12. Furthermore, as previously described, since the allowable maximum acceleration applied to the building 12 is slightly larger than the acceleration $\alpha_1$, even if an extremely large earthquake occurs, the building 12 itself will be neither damaged nor destroyed. When such an extremely large earthquake occurs, the relationship between the horizontal force F and the displacement $\delta$ of the building 12 from the initial position is illustrated in FIG. 10. Line segments $A_1$, $B_1$, $C_1$, $D_1$ and $E_1$ represent the same states of the building 12 as in FIG. 9. Line segments $G_1$ and $H_1$ indicate states of the building 12 when sliding between the sliding plate 34 and the connecting plate 32 occurs. The region surrounded by the above segments indicates energy consumption of a cycle of the sliding of the building 12.

According to the seismic isolator as described above, sufficient seismic proofing is provided to the building itself when a relatively small earthquake having a magnitude smaller than a medium magnitude occurs. Thus, the seismic isolator can have the so called trigger function by the second support for the acceleration response. Therefore, in the seismic isolator of the present invention, seismic isolation need not be considered for such relatively small earthquakes. The seismic isolator of the present invention can be effectively used to sufficiently protect a building against medium to large earthquakes which occur frequently by the trigger function. When such a medium to large earthquake occurs, the building can be protected. When such an earthquake has finished, the system including the building can be quickly restored to its initial state. In addition, even if an extremely large earthquake occurs, the building itself can be protected from damage and destruction.

Figure 11:
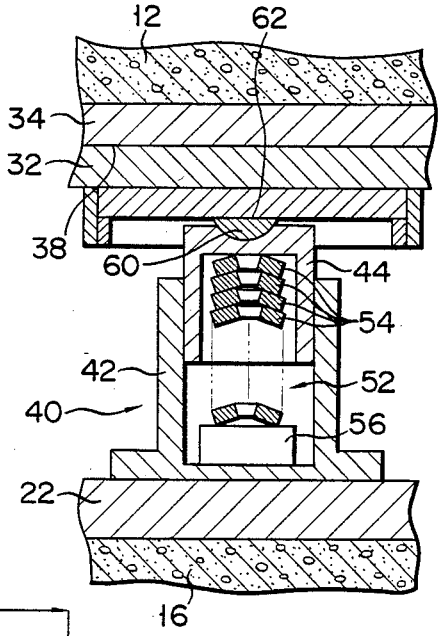
FIG. 11 is a sectional view of a modification showing part of the seismic isolator of the present invention.

The present invention is not limited to the particular embodiment described above. For example, FIG. 11 shows a modification of the seismic isolation described above. In this modification, the upper surface of the piston 44 is not brought into direct contact with the auxiliary sliding plate 46. The piston 44 is brought into tight contact with the auxiliary sliding plate 46 through a semi-circular sliding member 60. The sliding member 60 is fitted with the piston 44 so as to constitute a circular pair. Therefore, when the seismic isolator has this sliding member 60, the sliding member 60 is constantly urged against the auxiliary sliding plate 46 with a flat surface pressure, even if the piston 44 is not accurately cross to the auxiliary sliding plate 46 at right angles.

What is claimed is:

1. A seismic isolator, disposed between a structure and a foundation, for decreasing earthquake vibrations to be transmitted to the structure, comprising:

a first sliding plate fixed on a lower surface of the structure and having a lower surface as a first sliding surface;

a second sliding plate having a second sliding surface brought into slidable contact with the first sliding surface of the first sliding plate;

first supporting members disposed between the second sliding plate and the foundation and having at least horizontal elasticity, the first supporting members having a lower end fixed on the foundation and an upper end fixed on a lower surface of the second sliding plate;

second supporting members disposed between the second sliding plate and the foundation to be dynamically parallel to the first supporting members and having elasticity only along a vertical direction, the second supporting members having a lower end fixed on the foundation and an upper end brought into tight contact with a lower surface of the second sliding plate, and the second sliding plate having the second sliding surface slidable on the upper end of the second supporting members, the frictional force required for the relative sliding between the first and second sliding plates being designed to be greater than that required for the relative sliding between the second sliding plate and the upper surface of the second supporting members;

adjusting and holding members for adjusting an urging force acting on the lower surface of the second sliding plate through the upper end of the second supporting members.

2. A seismic isolator according to claim 1, wherein the second supporting members comprise: a cylinder disposed below the second sliding plate, having an axis aligned with a vertical direction and an opening at an upper end thereof; a piston fitted in the cylinder and slidable along the vertical direction; and biasing members, disposed in the cylinder, for biasing the piston upward, whereby the piston extends upward from the opening of the cylinder and is urged against the second sliding surface of the second sliding plate.

3. A seismic isolator according to claim 2, wherein the biasing members comprise a spring member obtained by stacking a plurality of disk springs.

4. A seismic isolator according to claim 1, wherein the first supporting members comprise a plurality of column-like or rectangular prism-like elastic members each having an axis aligned with a vertical direction.

5. A seismic isolator according to claim 4, wherein the elastic member comprises vibration proof rubber or laminated rubber bearing.

6. A seismic isolator according to claim 4, wherein the elastic member of first supporting members is arranged to surround the second supporting members.

7. A seismic isolator according to claim 1, further comprising stopper members mounted on the lower surface of the second sliding plate to restrict a sliding distance of the second sliding plate with respect to the upper end of the second supporting members.

8. A seismic isolator according to claim 7, wherein the stopper members have a stopper ring fixed on the lower surface of the second sliding plate to surround the upper end of second supporting members.

9. A seismic isolator according to claim 8, wherein the stopper members further have a buffer ring fixed on an inner surface of the stopper ring to damp an impact between the stopper ring and the upper end of the second supporting members.

10. A seismic isolator according to claim 8, wherein a maximum sliding distance of the second sliding plate which is restricted by the stopper members is shorter than an allowable maximum deformation of the first supporting members.

11. A seismic isolator according to claim 2, wherein the second supporting members further include a semicircular sliding member projecting from the opening of the cylinder and swingably fitted to the upper surface of the piston, the sliding member having a flat contact surface which is in slidable contact with the second sliding surface of the second sliding plate.

* * * * *